United States Patent [19]

Ginsburg

[11] 4,135,716

[45] Jan. 23, 1979

[54] PORTABLE MEANS FOR SUPPORTING A NET

[76] Inventor: Sam Ginsburg, 10709 Ashton Ave., Los Angeles, Calif. 90024

[21] Appl. No.: 735,623

[22] Filed: Oct. 26, 1976

[51] Int. Cl.[2] ..... A63B 69/00

[52] U.S. Cl. ..... 273/29 BC; 273/95 R

[58] Field of Search ..... 273/29 B, 29 BB, 29 BC, 273/29 BA, 1 R, 30, 181 F, 181 J, 176 F, 181 K, 195 A, 184, 55 R, 55 A, 55 B, 95 R

[56] References Cited

U.S. PATENT DOCUMENTS

| | | | |
|---|---|---|---|
| 494,913 | 4/1893 | Booth | 273/29 BA |
| 1,327,072 | 1/1920 | Thorward | 273/29 BB |
| 2,937,872 | 5/1960 | Gilman | 273/55 A |
| 3,940,139 | 2/1976 | Barnes | 273/29 B |
| 3,980,299 | 9/1976 | Brown | 273/29 B |
| 3,986,719 | 10/1976 | Lee | 273/181 F |

FOREIGN PATENT DOCUMENTS

| | | | |
|---|---|---|---|
| 207917 | 12/1923 | United Kingdom | 273/29 BB |
| 342410 | 2/1931 | United Kingdom | 273/29 BB |
| 403184 | 12/1933 | United Kingdom | 273/29 BB |

*Primary Examiner*—Richard C. Pinkham
*Assistant Examiner*—T. Brown
*Attorney, Agent, or Firm*—Blakely, Sokoloff, Taylor & Zafman

[57] ABSTRACT

The present invention is a knock-down, portable structure enabling the easy and rapid erection of a tennis, badminton or volleyball court on any relatively flat and hard surface. This invention comprises the combination of (i) a dual purpose net; (ii) one or more pairs of poles to which the net is affixed, the length of the pole pair being that commensurate with the required net height; and (iii) structure for stably supporting the pole pair without drilling into the ground surface.

10 Claims, 4 Drawing Figures

PORTABLE MEANS FOR SUPPORTING A NET

DOCUMENT DISCLOSURE PROGRAM

A disclosure of the present invention was filed with the U.S. Patent and Trademark Office, under the latter's Disclosure Document Program, on Oct. 10, 1975 and was assigned No. 044194.

BACKGROUND OF THE INVENTION

1. Field of Invention

This invention relates generally to the field of sporting goods and equipment, and more particularly, to portable means for supporting a net required for sports such as tennis, badminton and volleyball.

2. Prior Art

During the past decade, interest and participation in the sport of tennis has increased to an all-time high in the United States and in many countries of the world. In the United States alone, it is estimated that over 20 million people play tennis.

All over the country, new tennis clubs are being constructed and private and municipal tennis courts are being put in at an unprecedented rate. Yet, the public's demand and need for tennis courts remains unsatisfied. For many tennis players the choice is often between long waits at municipal courts or the expense of membership in a private club or tennis court rental fees. For young children and teenagers interested in tennis, there is typically no choice. They must wait for a public tennis court for periods of time which are often far greater than their actual playing time, thereby wasting time which could otherwise be used for exercise or study.

There are many available areas having flat, hard (paved or concrete) surfaces, such as school yards and outdoor parking lots which, when not being used for their primary purpose, are suitable for the playing of tennis (or other net sports). Yet, while the public's need for tennis courts is generally unsatisfied, many such available areas, having surfaces suitable for tennis, remain empty and unused, particularly on weekends when the demand for tennis courts is at its peak. What has been required, but heretofore not available, is a knock-down, portable means for erecting a tennis (or other) court on such surface without drilling into or otherwise altering the surface. The present invention discloses such means, thereby satisfying the long-felt need to utilize areas such as school yards and parking lots for tennis and other net sports when these areas are not being put to their primary uses.

The prior art teaches means for supporting net poles in the upright position which utilize ground anchor means such as augers or helically shaped anchors for securing the posts. U.S. Pat. No. 3,076,532, issued to N. V. Frye, discloses ground anchors which are embedded in the ground surface in order to provide support. Such support means are unsatisfactory for portable tennis court use on parking lots and school yards because they cause permanent holes in the surface. Moreover, the ground anchors disclosed in the Frye patent are adapted for use on a ground surface which is comparatively soft and yielding, such as sod, gravel and the like. This is a significant limitation if such anchors are to be used in the type of ground surface particularly suited for tennis, such as asphalt or concrete.

U.S. Pat. No. 3,216,681, issued to P. Tagliavia discloses a base, typically weighted with sand or other dense materials, for supporting large sunshades of the beach-umbrella type. The base consists of a pair of hollow pan-shaped members which receive the shaft of the umbrella and which are filled with stones, sand bags or the like. The pan-shaped members have a circular cross-section, so the ballast material is evenly distributed around the shaft. While such a base support may be suitable for supporting sunshades vertically, it would not be suitable for supporting poles attached to nets which require a substantial degree of tension. This is because the force of a net under tension (acting in a direction perpendicular to the pole) would tend to cause the base support, and the poles supported thereon, to lean inward toward the center of the court, thereby reducing the tension in the net. In addition to the required tension of the net, the weight of the net and the impact forces of the ball, particularly a volleyball, would further cause the base supports and poles to lean inward, even to a point beyond their centers of gravity which could cause them to topple over. To utilize the structure disclosed by Tagliavia for supporting a tennis or volleyball net would require very great ballast weight to mitigate the undesirable tendency of the poles to lean inward. Use of such additional ballast weight would decrease the portability of the device.

In U.S. Pat. No. 582,973, issued to J. W. Beaman, a tripod-like pole support stand is disclosed. This structure does not include a weighted base, and therefore, is even less suitable for use in supporting the poles of a tennis or volleyball court than that disclosed in U.S. Pat. No. 3,216,681 (Tagliavia).

The present invention overcomes the foregoing limitations and shortcomings of the prior art by disclosing a structure which can be used on hard surfaces without drilling holes therein and which can stably support a net having the required tension.

BRIEF SUMMARY OF THE INVENTION

The present invention is a portable structure enabling the easy and rapid erection of a tennis, badminton or volleyball court on any relatively flat and hard surface. The invention comprises the combination of (i) a dual purpose net, (ii) one or more pairs of poles to which the net is attached, and (iii) base members and ballast for stably supporting the poles and attached net without requiring drilling into the ground surface.

The present invention contemplates the use of a light weight, inexpensive dual purpose net suitable for tennis, volleyball or badminton. In the preferred embodiment of this invention, the net used has the standard height for tennis nets; however, two guages of mesh are used. In the upper half of the net, the guage of the mesh is suitable for tennis, while in the remaining lower half of the net, the guage is suitable for volleyball. When the invention is being used for tennis, balls striking the upper half of the net are blocked (like a conventional tennis net), while balls striking the lower half of the net may pass through the larger mesh of the net (unlike a conventional tennis net). However, this is advantageous to the players because, by passing through the net to the player on the opposite side of the net, the number of ball retrieval trips to the net is reduced. The net also is used for volleyball by supporting it at the appropriate height. For volleyball, players can view the opposite side of the court through the bottom half of the net, which has the larger guage mesh, as is the case with a conventional volleyball net. With respect to the upper portion of the net having the tennis guage mesh, it is sufficiently far above a volleyball player's line of sight, when following the movement of the ball on the opposite side of the net, that there is no significant obstruction of the player's view.

The net is supported by one or more pairs of poles supported by the base members. The height of the first pair of poles is that suitable for tennis. The net may be attached to the poles by conventional means. After initial placement of the poles and base members, the net cords are pulled and secured so as to achieve some tension. The full net tension required is then achieved by the final placement of the poles and base members.

In a preferred embodiment of the invention two pairs of poles are utilized. Each pole of the first pair of poles is a hollow tubular member, while each pole of the second pair is a tubular member having a diameter smaller than that of the first pair of poles. This enables the second pair of poles to slidably fit within corresponding poles of the first pair in a telescoping fashion.

When the above-described preferred embodiment is to be used for tennis, each of the first pair of poles is placed into a base member, while each of the second pair of poles is received into corresponding poles of the first pair. When this embodiment is to be used for volleyball or badminton, each of the second pair of poles is extended out from the corresponding first pole in which it has been received, raising it to a pre-determined height at which it is secured. After such extension is completed, the dual purpose net is attached to the second pair of poles. By virtue of the pre-determined height of the poles, the net is supported at a height suitable for volleyball or badminton.

Each base member typically comprises a tripod-like stand having means for receiving and locking the first pair of poles, one leg of the tripod having an extended member disposed along the ground surface opposite the net. Sand bags or other ballast weights are then placed over the extended member, and the weight of the ballast, together with the leverage obtained by the extended member, provide sufficient support to secure the poles against the tension of the net.

It is understood, of course, that prior to use of the present invention, the court lines will have been marked by appropriate means, such as chalk or tape if temporary markings are used, or by painting the lines if the court boundaries are permanently laid out.

Thus, a principal object of the present invention is to provide a portable means for rapidly constructing a net court game on any flat, hard surface.

Another principal object of this invention is to utilize available surfaces for tennis or other games, without altering or drilling into such surfaces, when the latter are not being used for their primary purposes.

A still further object of this invention is to provide simple, but effective, means for maintaining the required tension of the net.

Other objects and novel features of the present invention will become apparent upon making reference to the following detailed description and the accompanying drawings. The description and the drawings will also further disclose the characteristics of this invention, both as to its structure and its mode of operation. Although a preferred embodiment of the invention is described hereinbelow, and shown in the accompanying drawings, it is expressly understood that the descriptions and drawings thereof are for the purpose of illustration only and do not limit the scope of this invention.

DETAILED DESCRIPTION OF THE INVENTION

Figure 1:
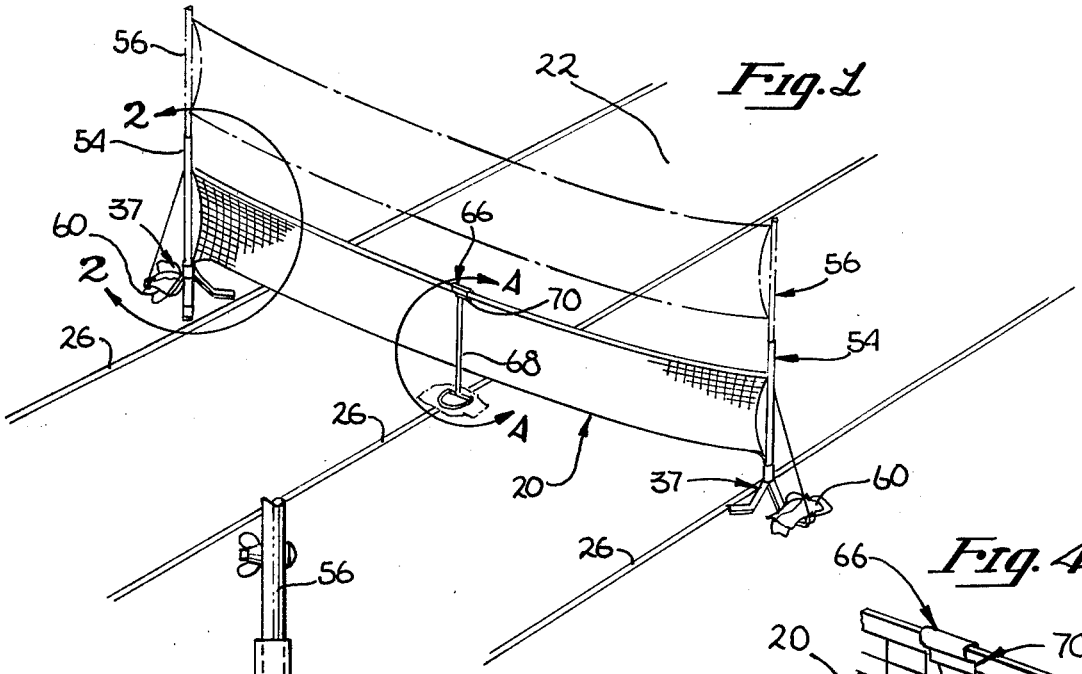
FIG. 1 is a perspective view of a preferred embodiment of the present invention as set up for tennis play.

First referring to FIG. 1, a perspective view of the preferred embodiment of the invention, set up for the game of tennis and illustrated in phantom line for the games of badminton and volleyball, is shown. The invention is set up on a court area 22 which has been marked out by a plurality of lines 26 to define the boundaries of the court for the game to be played (specifically, tennis in the set-up illustrated). Since the present invention is suitable for a variety of net games (i.e., tennis, badminton and volleyball), the marking of the court by way of lines 26 will be those suitable for the game to be played and in the case of tennis, for either singles or doubles. The marking of the lines 26 may be accomplished by means well known in the art, such as, by way of example, temporary chalk lines achieved by rolling hydrated lime (thinned to a water consistency) over previously laid down snap lines with a 2½ inch paint roller coupled to a hand held pole. Obviously, however, other marking means may be used, such as suitable tape. While chalk lines may be readily removed with a water hose, taped lines will provide a longer lasting (although still temporary) and readily removable marking.

Figure 2:
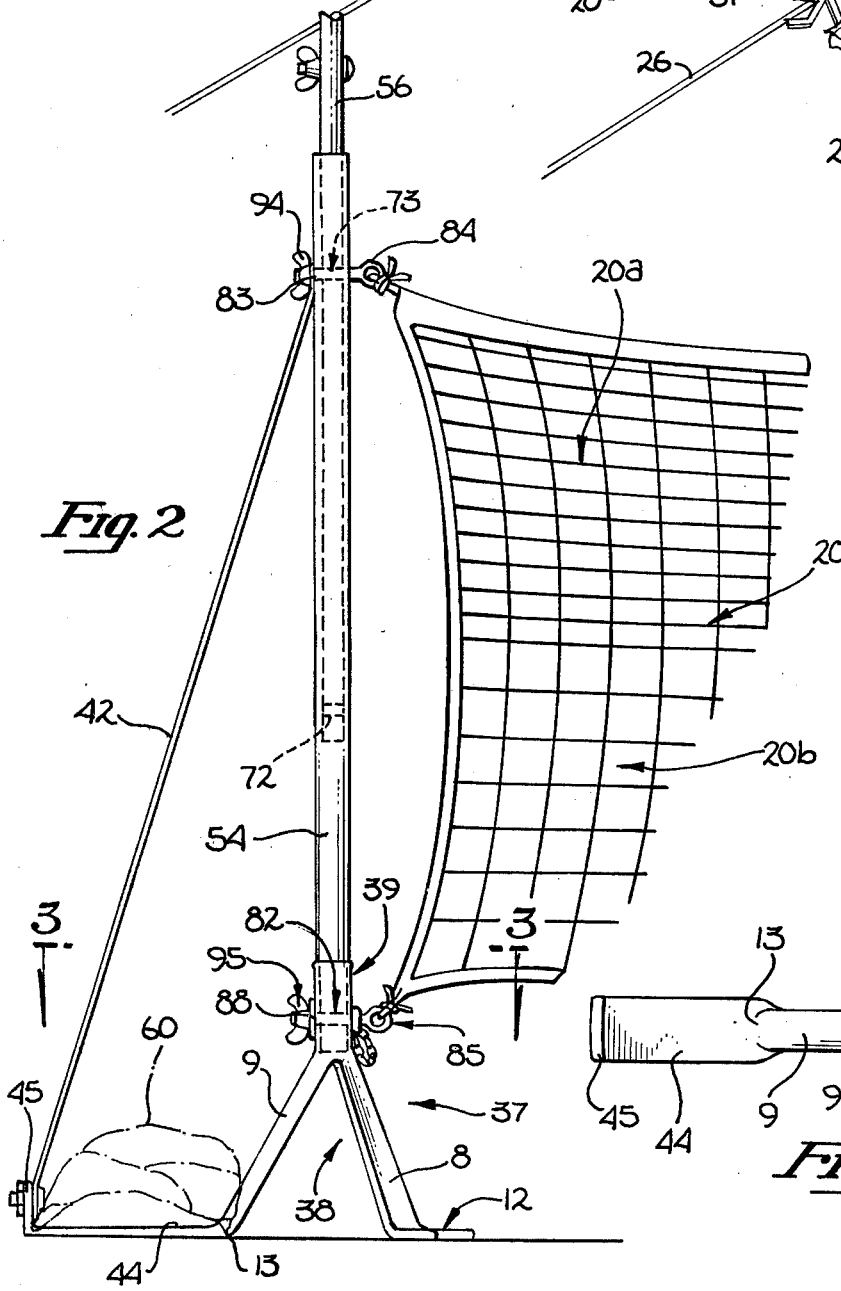
FIG. 2 is a close-up view of one side of the invention as shown in FIG. 1, showing a portion of the net, one each of the first and second pole pairs, one base member and ballast.

With reference to FIG. 2, a dual purpose net 20, suitable for use as a tennis net or volleyball/badminton net, is now described. The net 20 comprises an upper half 20*a* and a lower half 20*b*. The mesh of the upper half 20*a* of net 20 has a guage suitable for tennis, while the mesh of lower half 20*b* thereof has a guage suitable for volleyball. As indicated above, when the invention is being used for tennis, balls striking the upper half 20*a* of the net 20 are blocked (like a conventional tennis net), while balls striking the lower half 20*b* of the net may pass through the larger mesh of the net (unlike a conventional tennis net). However, this may prove advantageous to the players because, by passing through the net to the player on the opposite side of the net, the number of ball retrieval trips to the net is reduced. When used for volleyball, the players can view the opposite side of the court through the bottom half 20*b* of the net 20, which has the larger guage mesh, as is the case with a conventional volleyball net, while the smaller tennis guage mesh in the upper half 20*a* is sufficiently above a volleyball player's line of sight to not significantly obstruct the player's view.

Typically, the net 20 has a height equal to the standard tennis net. The length of the net may be chosen according to the requirements of a particular game; for example, for use for both singles tennis and volleyball, a net length of 32 feet would be suitable, inasmuch as a standard singles tennis court is 27 feet wide, while a volleyball court is 30 feet wide. To accommodate a tennis doubles court, the net must be 36 feet long. The present invention may be utilized with any length of net needed for the particular game.

The invention further comprises at least one pair of poles 54 for supporting the net 20 just above the surface of a court marked for tennis. Such an embodiment would have a single purpose, i.e, to enable tennis to be played. Therefore, the net 20 would not need to be the dual-purpose, dual mesh net described above. Instead, a conventional tennis net could be use. However, the preferred embodiment of the invention enables both low net games (tennis) and high net games (volleyball and badminton) to be played on the marked court 22. For such dual use, the preferred embodiment utilizes a second pair of poles 56 insertable into first pair of poles 54 in a telescopic manner. As shown in FIG. 2, each pole 54 of the first pole pair is made of a hollow tubular member having an inner diameter greater than the outer diameter of the corresponding pole 56 of the second pole pair, thereby enabling the pole 56 to be inserted into and extended out from pole 54. In this embodiment, two positions of pole 56 relative to pole 54 are contemplated; the first being the fully inserted position, while the second is the fully extended position. Conventional means for securing pole 56 in either of said two positions relative to pole 54 are provided, as now described.

Pole 56 has lower and upper holes 72 and 73 respectively extending therethrough in a direction perpendicular to the longitudinal (vertical) axis of the pole. Pole 54, into which pole 56 is inserted, likewise has lower and upper holes 82 and 83 respectively extending therethrough in a direction perpendicular to its longitudinal axis. Pole 56 is typically in its fully inserted position when the invention is being used for tennis. To secure pole 56 in the fully inserted position, hole 73 therein is aligned with hole 83 of pole 54 and a securing bolt 84 is passed therethrough. A wingnut 94 may be used to fasten bolt 84 in place. To secure pole 56 in the fully extended position, lower hole 72 therein is aligned with hole 83 of pole 54 and securing bolt 84 passed therethrough. Again, bolt 84 may be fastened in place by means of wingnut 94.

The length of poles 54 must be sufficient to enable the support of net 20 in the appropriate position for tennis play. The length of poles 56 and the respective locations of hole 72 of pole 56 and hole 83 of pole 54 must be selected so that the elevation of poles 56 enables the support of net 20 at the appropriate distance above the court 22, as required for volleyball or badminton. The location of hole 73 in poles 56 in respect to hole 83 in pole 54 is not critical, but determines the extent to which pole 56 may extend out from pole 54 in the fully inserted position.

Figure 3:
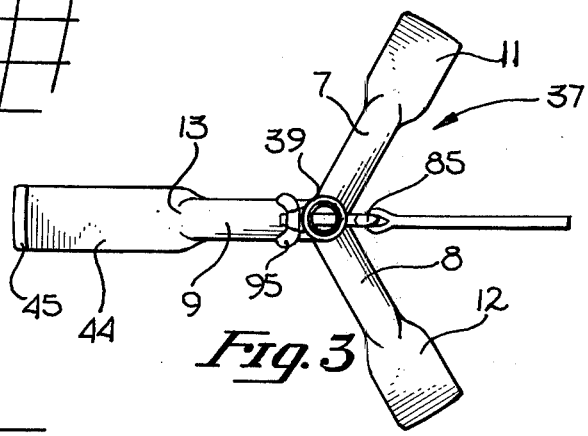
FIG. 3 is a top view of the base member, showing the extension member.

Referring to FIGS. 2 and 3, a base member 37, used to support pole 54 (and 56 inserted therein), is described. Obviously, a pair of base members 37 are required, as shown in FIG. 1, since the poles are in pairs. The base member 37 comprises (i) means for receiving and securing the pole 54; and (ii) support means. In the preferred embodiment being described herein, the means for receiving and securing pole 54 is a hollow tubular collar 39 whose inner diameter is slightly larger than the outer diameter of pole 54 and which, therefore, is adapted to receive the end of pole 54. Collar 39 of base member 37 has a hole 88 extending through it in a direction perpendicular to its longitudinal (vertical) axis. In order to secure pole 54 to base member 37, hole 82 of pole 54 is aligned with hole 88 of collar 39 and a bolt 85 inserted therethrough. A wingnut 95 may be used to fasten bolt 85 in place.

In this preferred embodiment, the support means 38 comprises three tripod-like legs 7, 8 and 9, the upper portions of which are integral with or mechanically secured to the lower portions of collar 39. The legs 7, 8 and 9 are typically spaced at 120° from one another, as shown in the top view of FIG. 3. However, those skilled in the art may select other angular displacements as a function of the required directional stability of the base member 37 and magnitude of the ballast weight (described below).

Generally horizontal contact pads 11, 12 and 13 are formed at the lower ends of legs 7, 8 and 9 respectively of the support means portion 38 of base member 37. An extension member 44 is integral with or mechanically fastened to the contact pad 13. The purpose of extension member 44 is to receive a ballast weight 60 and to provide a lever arm therefor, so as to increase the stabilizing effect of the ballast weight 60 on the base member 37. The outer end 45 of extension member 44 is bent upward to provide a means for restraining the ballast weight 60 against undesired movement off the extension member.

The ballast weight 60 serves to hold the base member 37 securely in place on the ground surface against the tension force of the net 20. In this embodiment, the preferred ballast weight for each base member 37 is provided by a plurality of sandbags 60, typically five sandbags weighing approximately 6 pounds each. As indicated above, the sandbags 60 are placed on extension member 44 of leg 9 of the base member 37, the extension member providing a lever arm to increase the stabilizing effect of the weight. Without such an extension member, more ballast weight would be required to achieve the same degree of stability.

The ability of the combination of poles 54, poles 56, base member 37 and ballast weight 60 to stably support the net 20 with the requisite tension is a function of (i) the material from which the poles 54 and 56 are made (which determines their rigidity); (ii) the fit of pole 54 into collar 39; and (iii) the fit of pole 56 into pole 54 (when the invention is used for high net games). While a plastic material, such as polyvinyl chloride (PVC) is generally suitable for the poles 54 and 56 because of its light weight (enhancing the portability of the invention) and its cost, it may not be sufficiently rigid for those who desire a minimum of net sag. In this connection, metals are preferable to PVC or other plastics because of their greater rigidity, and aluminum is the preferred metal because of its light weight.

With respect to the fit of the above-described components, the tightest possible fit is required which does not bind the poles 54 and 56 and/or base member 37 when the components are being assembled or disassembled.

To further enhance the stability of the poles and base member, an additional stabilizing member may be affixed between outer end 45 of extension member 44 and the upper portion of either pole 54 (in the low net configuration) or pole 56 (in the high net configuration). In FIG. 2, a guy wire or cable 42 is shown as such an additional stabilizing member. Wire or cable 42 may be removably or permanently affixed to the end 45 of extension member 44 and the pole by conventional means, such as attaching a hook to the wire or cable for securing through a hole, or nut and bolt pair. If additional stabilizing means is desired for both the high net and low net configurations, two wires or cables 42 of different lengths would be provided and used selectively for each configuration. The use of a guy wire or cable 42 has the incidental benefit of constraining the undesirable movement of the sand bags 60.

The base member 37 should be made of a strong, inexpensive metal which provides sufficient weight to enhance stability without significantly decreasing its portability. Steel is a suitable metal for the base member 37 in that it satisfies the foregoing requirements.

The net 20 is attached to the first pole pair 54 for tennis and to the second pole pair 56 for volleyball/badminton by any of a number of conventional means. For example, the cords of net 20 may be wrapped around the poles, or tied through eyelets fastened to the poles. In the embodiment of FIG. 2, bolts 84 and 85 have eyelets used for holding the net 20. Thus, bolts 84 and 85 have a dual function; i.e., securing pole 56 inside pole 54 and pole 54 in collar 39, as well as providing the means for attaching the net. Other means for attaching the net 20 to the pole pairs will be obvious to those skilled in the field. One such means is to attach a clasp hook to each end of the upper and lower net cords, such clasp hooks then being hooked through the eyelets of corresponding bolts 84 and 85.

In the tennis (low net) configuration of the present invention, additional support means 66, disposed at the center of the net 20, may be advantageously used (i) to maintain the correct height of the net at the center (36 inches); (ii) to prevent the net from leaning on either side of the center, especially under wind loads; and (iii) to keep the bottom of center of the the net from billowing out. A suitable support means 66 is shown generally in FIG. 1 and in greater detail in FIG. 4.

Figure 4:
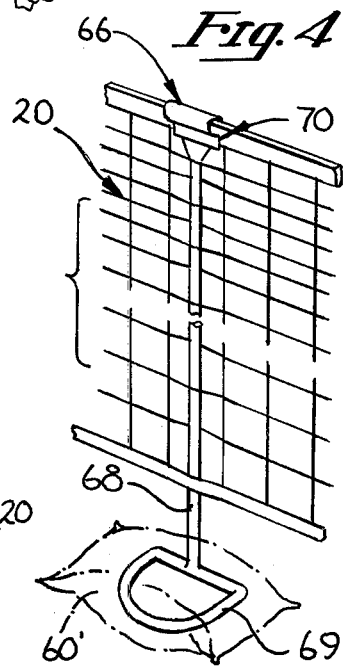
FIG. 4 is a close-up view of a net center support rod and ballast.

With reference to FIG. 4, center support means 66 is now described. It comprises a rod 68 extending upward from a horizontal base 69 and having a conventional clamping means 70 at its upper end. The rod 68 is preferably intertwined through the mesh openings of the net 20 at places in the lower, center and upper portions of the net. The tape of net 20 is removably secured to the center support means 66 by clamping means 70. The length of the rod 68 and the thickness of the base 69 are such that the point at which the net tape is secured to clamping means 70 is the conventional tennis net height of 36 inches. A ballast weight, preferable a 6 pound sandbag 60' is placed on top of base 69 to stably support the rod 68 and the net 20.

Having described the structure of the preferred embodiment, the operation of the invention is now described. As has been disclosed the invention comprises several component parts, for easy portability. Thus, the base members 37, the pole pairs 54 and 56, the net 20 and the ballast weight 60, when disassembled may be transported in the trunk of a car or carried on other means of transportation. The portable court may be set up on parking lots, playgrounds, indoor gymnasiums or any other substantially flat surface. After the court lines 26 are marked, the base members 37 are first disposed the proper distance apart for the game to be played. They are oriented so that their extension members 44 are aligned with net 20 and extend outwardly away from the net. The first pole pair 54 is then inserted in the collars 39 of the base members 37 and secured by bolts 85. If the game to be played is volleyball or badminton, the telescoping second pole pair 56 is placed in its fully extended position and locked in place by bolts 84. Stabilizing cables 42 may then be attached, if desired. Next, the ballast 60 is positioned on the extension members 44. The net 20 is then attached to the first pole pair 54 for tennis or to the second pole pair 56 for the high net games. For tennis, the center support means 66 and ballast 60' are installed in position at the center of net 20. At this time, the appropriate tension of the net 20 is achieved by positioning the base members 37 and by tightening the net cords. The net 20 is then in position for the game to be played.

While the present invention has been described and illustrated in connection with a preferred embodiment, modifications and variations will readily occur to those skilled in the art without departing from the spirit and scope of the invention as defined in the appended claims.

I claim:

1. A portable net structure comprising:
a net;
a first pair of poles;
a second pair of poles, each hollow and adapted for insertably receiving at least a portion of one of said first pair of poles;
means for securing each of said first pair of poles in an inserted position within a corresponding pole of said second pair;
means for securing each of said first pair of poles in a partially extended position within a corresponding pole of said second pair of poles;
base means for supporting each of said second poles;
ballast weight; and
extended member coupled to said base means and extending outwardly away in general alignment with said net for receiving said ballast weight to secure said base means and poles against the tension exerted by said net;
each of said first and second pair of poles having net attachment means attached thereto;
whereby said net may be selectively affixed to either said first pair of poles in said extended position or to said second pair of poles, for vertical adjustment thereof.

2. The structure of claim 1 wherein the height of each of said pair of poles when supported by said base means and in said inserted position is arranged and configured to support said net at the proper elevation for tennis play, and wherein the height of each of said first pair of poles when secured in said extended position is arranged and configured to support said net at the proper elevation for high net games.

3. A portable net structure comprising:
a net having an upper and lower portion, the gauge of the mesh of said upper portion of said net being reduced with respect to the guage of the mesh of said lower portion of said net;
a first pair of poles;
a second pair of poles, each hollow and adapted for insertably receiving at least a portion of one of said first pair of poles;
means for securing each of said first pair of poles in an inserted position within a corresponding pole of said second pair of poles;
means for securing each of said first pair of poles in a partially extended position from a corresponding pole of said second pair of poles;
base means for supporting said second pair of poles;
sand bags; and
an extended member having a first and second end, said extended member extending outwardly away from said base means in general alignment with said net for receiving said sand bags to secure each of said base means and poles against tension in said net, said first end being coupled to said base means and said second end of said extended member being curved upward to retain said sand bags;

each of said first and second pair of poles having net attachment means attached thereto;

wherein said net may be selectively affixed to either said first pair of poles in said extended position or to said second pair of poles, for vertical adjustment thereof.

4. A portable net structure comprising:

a net having a mesh;

at least one pair of poles to which said net is affixed;

a pair of base members, each having a collar adapted to receive and secure one pole of said pair of poles, each of said base members further having three tripod-like legs coupled to said collar;

ballast weights; and a corresponding pair of extended members, one of said extended members coupled to one of said legs of each base member and extending outwardly away in general alignment with said net for receiving said ballast weight to secure said base member and pole against the tension exerted by said net.

5. The structure of claim 4 wherein said ballast weight comprises one or more sand bags.

6. The structure of claim 5 wherein said extended member has a first and second end, said first end being coupled to said base means and said second end being curved upward to retain said sand bag.

7. The structure of claim 4 having in addition thereto a stabilizing member extending between each pole of said pair of poles and a corresponding one of said extended members for enhancing the stability of said structure against said tension in said net.

8. The structure of claim 7 wherein said stabilizing member comprises a guy wire.

9. A portable net structure comprising:

a net having a mesh, said net comprising an upper and lower portion, the gauge of the mesh of said upper portion of said net being reduced with respect to the gauge of the mesh of said lower portion of said net;

at least one pair of poles to which said net is affixed;

a pair of base members, each having a collar adapted to receive and secure one pole of said pair of poles, each of said base members further having three tripod-like legs coupled to said collar;

ballast weights; and a corresponding pair of extended members, one of said extended members coupled to one of said legs of each base member and extending outwardly away in general alignment with said net for receiving said ballast weight to secure said base member and pole against the tension exerted by said net.

10. A portable net structure comprising:

a net having a mesh;

at least one pair of poles to which said net is affixed;

a pair of base members, each having a collar adapted to receive and secure one pole of said pair of poles, each of said base members further having three tripod-like legs coupled to said collar;

ballast weights;

a corresponding pair of extended members, one of said extended members coupled to one of said legs of each base member and extending outwardly away in general alignment with said net for receiving said ballast weight to secure said base member and pole against the tension exerted by said net, and a center support means affixed to said net at a point midway between said base members, said means including:

an elongated member having a first and second end;

a clamp means affixed to said first end of said elongated member for removably securing said center support means to the top of said net, the length of said elongated member being arranged and configured to support the center of said net at an elevation suitable for tennis play;

a second ballast means; and a base member affixed to said second end of said elongated member for contacting the ground surface and receiving a second ballast means.

* * * * *